US006006557A

United States Patent [19]

Carl et al.

[11] Patent Number: 6,006,557

[45] Date of Patent: Dec. 28, 1999

[54] COMPUTER PHYSICAL SECURITY DEVICE

[75] Inventors: Stewart R. Carl, Palo Alto; Alice Kasahara, Hayward; Arthur H. Zarnowitz, San Jose; William R. Murray, Jr., Redwood City, all of Calif.

[73] Assignee: ACCO Brands, Inc., Lincolnshire, Ill.

[21] Appl. No.: 08/927,334

[22] Filed: Sep. 11, 1997

Related U.S. Application Data

[63] Continuation of application No. 08/385,715, Feb. 8, 1995, abandoned.

[51] Int. Cl.[6] ..... F05B 69/00

[52] U.S. Cl. ..... 70/58; 70/14; 70/57

[58] Field of Search ..... 70/58, 14, 57, 70/423–430, 18, 232; 248/553, 551, 505; 411/552, 553, 555, 549, 349, 343, 216, 217

[56] References Cited

U.S. PATENT DOCUMENTS

| | | | |
|---|---|---|---|
| D. 232,416 | 8/1974 | Gazda et al. . | |
| 285,074 | 9/1883 | Rhoades et al. | 70/424 |
| D. 370,473 | 6/1996 | Derman . | |
| 505,299 | 9/1893 | Schneider . | |
| 606,734 | 7/1898 | Olmstead . | |

(List continued on next page.)

FOREIGN PATENT DOCUMENTS

| | | | |
|---|---|---|---|
| 454901 | 3/1949 | Canada . | |
| 791364 | 8/1968 | Canada . | |
| 987121 | 4/1976 | Canada . | |
| 455740 | 3/1913 | France | 70/424 |
| 1085107 | 6/1953 | France . | |
| 2308006 | 4/1976 | France . | |
| 2636686 | 3/1990 | France . | |
| 1026519 | 10/1990 | France . | |
| 456219 | 2/1921 | German Dem. Rep. . | |
| 329934 | 12/1920 | Germany . | |
| 335741 | 4/1921 | Germany | 70/202 |
| 361068 | 4/1923 | Germany | 70/424 |
| 577757 | 5/1933 | Germany . | |
| 3824393 | 7/1989 | Germany . | |
| 451949 | 10/1949 | Italy . | |
| 14095 | 11/1904 | Norway . | |
| 447091 | 5/1935 | United Kingdom . | |
| 447091 | 5/1936 | United Kingdom . | |
| 1256295 | 12/1971 | United Kingdom . | |
| 1376011 | 12/1974 | United Kingdom . | |
| 2109109 | 5/1983 | United Kingdom . | |

OTHER PUBLICATIONS

Kablit Security System Catalog, pp. 7, 93, 1988. *Computer and Office Equipment Security Catalog*, ©1990 by Secure–It, Inc., 18 Maple Court, East Long–meadow, Mass. 01028.

Kensington Product Brochure for Kensington Apple®, LaserWriter® and Macintosh® Portable Security Systems. *Computer and Office Equipment Security Catalog*, ©1990 by Secure–It, Inc. 18 Maple court, East Longmeadow, Ma 01028.

Apple Security Bracket sold in AS Kit.

Retaining Device Incorporated in Apple Computers.

*Primary Examiner*—Darnell M. Boucher

*Attorney, Agent, or Firm*—Michael E. Woods; Townsend and Townsend and Crew

[57] ABSTRACT

An apparatus which inhibits the theft of equipment such as personal computers is disclosed. The equipment typically includes an external wall provided with a specially designed, approximately rectangular slot having preselected dimensions. An attachment mechanism includes a housing for a spindle having a first portion rotatable within the housing, a shaft extending outwardly from the housing, and a crossmember at the end of the shaft having peripheral dimensions closely conforming to the internal dimensions of the slot. The spindle is then rotated 90° to misalign the crossmember with the slot, thereby attaching the attachment mechanism rigidly to the external wall. A cable is secured to the housing and to an immovable object so that the equipment cannot be stolen.

12 Claims, 10 Drawing Sheets

U.S. PATENT DOCUMENTS

| | | | |
|---|---|---|---|
| 611,646 | 10/1898 | Parker . | |
| 786,842 | 4/1905 | Robeson . | |
| 881,364 | 3/1908 | Wheeler . | |
| 934,928 | 9/1909 | Michel . | |
| 942,537 | 12/1909 | Batdorf . | |
| 952,411 | 3/1910 | Billy . | |
| 1,050,276 | 1/1913 | Johnson | 70/424 |
| 1,101,450 | 6/1914 | Kerry | 70/424 |
| 1,452,471 | 4/1923 | Kline . | |
| 1,470,937 | 10/1923 | Schou | 70/424 |
| 1,534,936 | 4/1925 | Fischbach . | |
| 1,672,333 | 6/1928 | Miller . | |
| 1,786,511 | 12/1930 | Warren . | |
| 2,130,216 | 9/1938 | Zaninovich . | |
| 2,190,661 | 2/1940 | Hauer . | |
| 2,383,397 | 8/1945 | Lofquist . | |
| 2,469,874 | 5/1949 | Fetsko, Jr. . | |
| 2,480,662 | 8/1949 | McKinzie . | |
| 2,594,012 | 4/1952 | Griffin . | |
| 2,660,084 | 11/1953 | Newman . | |
| 2,677,261 | 5/1954 | Jacobi . | |
| 2,729,418 | 1/1956 | Maynard . | |
| 2,800,090 | 7/1957 | Reid . | |
| 2,963,310 | 12/1960 | Abolins . | |
| 3,091,011 | 5/1963 | Campbell . | |
| 3,101,695 | 8/1963 | Honeyman, Jr. . | |
| 3,130,571 | 4/1964 | Neumann . | |
| 3,136,017 | 6/1964 | Preziosi . | |
| 3,171,182 | 3/1965 | Danehy . | |
| 3,200,694 | 8/1965 | Rapata . | |
| 3,220,077 | 11/1965 | Newcomer, Jr. et al. . | |
| 3,276,835 | 10/1966 | Hall . | |
| 3,469,874 | 9/1969 | Mercurio . | |
| 3,521,845 | 7/1970 | Sweda et al. . | |
| 3,590,608 | 7/1971 | Smyth et al. . | |
| 3,634,963 | 1/1972 | Hermann . | |
| 3,664,163 | 5/1972 | Foote . | |
| 3,722,329 | 3/1973 | Mestre . | |
| 3,727,934 | 4/1973 | Averbook et al. . | |
| 3,737,135 | 6/1973 | Bertolini . | |
| 3,754,420 | 8/1973 | Oellerich . | |
| 3,765,197 | 10/1973 | Foote . | |
| 3,771,338 | 11/1973 | Raskin . | |
| 3,772,645 | 11/1973 | Odenz et al. . | |
| 3,782,146 | 1/1974 | Franke . | |
| 3,785,183 | 1/1974 | Sander . | |
| 3,798,934 | 3/1974 | Wright et al. . | |
| 3,826,510 | 7/1974 | Halter . | |
| 3,859,826 | 1/1975 | Singer et al. . | |
| 3,866,873 | 2/1975 | Bohli . | |
| 3,875,645 | 4/1975 | Tucker et al. . | |
| 3,910,079 | 10/1975 | Gassaway . | |
| 3,910,081 | 10/1975 | Pender . | |
| 3,986,780 | 10/1976 | Nivet . | |
| 3,990,276 | 11/1976 | Shontz . | |
| 3,999,410 | 12/1976 | Hall . | |
| 4,003,228 | 1/1977 | Lievens et al. . | |
| 4,004,440 | 1/1977 | Dreyer . | |
| 4,007,613 | 2/1977 | Gassaway . | |
| 4,018,339 | 4/1977 | Pritz . | |
| 4,028,913 | 6/1977 | Falk . | |
| 4,028,916 | 6/1977 | Pender . | |
| 4,047,748 | 9/1977 | Whaley et al. . | |
| 4,055,973 | 11/1977 | Best . | |
| 4,057,984 | 11/1977 | Avaiusini . | |
| 4,065,083 | 12/1977 | Gassaway . | |
| 4,066,195 | 1/1978 | Dickler . | |
| 4,114,409 | 9/1978 | Scire . | |
| 4,118,902 | 10/1978 | Saxton . | |
| 4,123,922 | 11/1978 | Kuenstler . | |
| 4,131,001 | 12/1978 | Gotto . | |
| 4,212,175 | 7/1980 | Zakow . | |
| 4,223,542 | 9/1980 | Basseches . | |
| 4,252,007 | 2/1981 | Kerley . | |
| 4,300,371 | 11/1981 | Herwick et al. . | |
| 4,311,883 | 1/1982 | Kidney . | |
| 4,394,101 | 7/1983 | Richer . | |
| 4,418,550 | 12/1983 | Hamilton . | |
| 4,419,034 | 12/1983 | DiMartino . | |
| 4,442,571 | 4/1984 | Davis et al. . | |
| 4,448,049 | 5/1984 | Murray . | |
| 4,462,233 | 7/1984 | Horetzke . | |
| 4,527,405 | 7/1985 | Renick . | |
| 4,570,465 | 2/1986 | Bennett . | |
| 4,584,856 | 4/1986 | Petersdorff . | |
| 4,603,829 | 8/1986 | Koike et al. . | |
| 4,616,490 | 10/1986 | Robbins . | |
| 4,640,106 | 2/1987 | Derman . | |
| 4,655,057 | 4/1987 | Derman . | |
| 4,667,491 | 5/1987 | Lokken et al. . | |
| 4,676,080 | 6/1987 | Schwarz . | |
| 4,680,949 | 7/1987 | Stewart . | |
| 4,685,312 | 8/1987 | Lakoski . | |
| 4,691,891 | 9/1987 | Dionne . | |
| 4,704,881 | 11/1987 | Sloop, Sr. . | |
| 4,733,840 | 3/1988 | D'Amore . | |
| 4,738,428 | 4/1988 | Themistos et al. . | |
| 4,741,185 | 5/1988 | Weinert et al. . | |
| 4,768,361 | 9/1988 | Derman . | |
| 4,779,434 | 10/1988 | Derman . | |
| 4,805,426 | 2/1989 | Dimmick et al. . | |
| 4,826,193 | 5/1989 | Davis . | |
| 4,842,912 | 6/1989 | Hutter, III . | |
| 4,843,848 | 7/1989 | Igelmund . | |
| 4,856,304 | 8/1989 | Derman . | |
| 4,856,305 | 8/1989 | Adams . | |
| 4,858,455 | 8/1989 | Kuo . | |
| 4,862,716 | 9/1989 | Derman . | |
| 4,870,840 | 10/1989 | Klein . | |
| 4,893,488 | 1/1990 | Klein . | |
| 4,907,111 | 3/1990 | Derman . | |
| 4,907,716 | 3/1990 | Wankel et al. . | |
| 4,918,952 | 4/1990 | Lakoski . | |
| 4,924,683 | 5/1990 | Derman . | |
| 4,938,040 | 7/1990 | Humphreys, Jr. . | |
| 4,959,635 | 9/1990 | Wilson . | |
| 4,959,979 | 10/1990 | Filipow . | |
| 4,979,382 | 12/1990 | Perry . | |
| 4,985,695 | 1/1991 | Wilkinson et al. . | |
| 4,986,097 | 1/1991 | Derman . | |
| 4,993,244 | 2/1991 | Osman . | |
| 5,001,854 | 3/1991 | Derman . | |
| 5,010,748 | 4/1991 | Derman . | |
| 5,022,242 | 6/1991 | Povilaitis . | |
| 5,024,072 | 6/1991 | Lee . | |
| 5,027,627 | 7/1991 | Derman . | |
| 5,050,836 | 9/1991 | Makous . | |
| 5,052,199 | 10/1991 | Derman . | |
| 5,063,763 | 11/1991 | Johnson . | |
| 5,076,079 | 12/1991 | Monoson et al. . | |
| 5,082,232 | 1/1992 | Wilson . | |
| 5,082,233 | 1/1992 | Ayers et al. . | |
| 5,119,649 | 6/1992 | Spence . | |
| 5,184,798 | 2/1993 | Wilson . | |
| 5,197,706 | 3/1993 | Braithwaite et al. . | |
| 5,228,319 | 7/1993 | Holley et al. . | |
| 5,279,136 | 1/1994 | Perry . | |
| 5,327,752 | 7/1994 | Myers et al. . | |
| 5,349,834 | 9/1994 | Davidge . | |
| 5,351,507 | 10/1994 | Derman . | |
| 5,351,508 | 10/1994 | Kelley . | |
| 5,361,610 | 11/1994 | Sanders . | |

5,370,488 12/1994 Sykes .
5,381,685 1/1995 Carl et al. .
5,390,514 2/1995 Harmon .
5,390,977 2/1995 Miller .
5,398,530 3/1995 Derman .
5,400,622 3/1995 Harmon .
5,406,809 4/1995 Igelmund .
5,412,959 5/1995 Bentley .
5,421,667 6/1995 Leyden et al. .
5,466,022 11/1995 Derman .
5,489,173 2/1996 Höfle .
5,520,031 5/1996 Davidge .
5,579,657 12/1996 Makous .
5,603,416 2/1997 Richardson et al. .
5,608,605 3/1997 Siow et al. .

COMPUTER PHYSICAL SECURITY DEVICE

This is a Continuation of application Ser. No. 08/385,715, filed Feb. 8, 1995 now abandoned, the disclosure of which is incorporated by reference.

BACKGROUND OF THE INVENTION

The present invention relates generally to devices for inhibiting the theft of relatively small but expensive pieces of equipment. More specifically, the invention relates to a lock interface for a specially designed slot having predetermined dimensions.

Computers have evolved rather rapidly from large, expensive machines usable only by a few, to relatively small, portable machines which are usable by many. In particular, the development of desktop computers with significant processing power has made computers available to the general population. It is now common for college and even high school students to have their own computer, and desktop computers are in wide spread use as word processors and work stations in almost all forms of business. Desktop computers are relatively small and easily transportable, and an undesirable side effect of their proliferation is the fact that the theft of such computers is a significant problem.

A variety of devices have been developed to inhibit the theft of desktop computers and similar equipment. Since desktop computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment.

Kensington Microware Limited, assignee of this application, currently provides a security system which is especially designed for use with particular Apple computers. Certain Apple computer components have slots and internal brackets designed to capture a specially designed tab inserted through the slot so that the tab is not removable. While this system is effective for particular types of Apple computers, it does not work for those Apple computer components and other computer brands which do not have the special designed slots and brackets.

It is undesirable to require a computer to have specially designed slots and internal capture brackets because the brackets occupy a significant amount of space in an item of equipment which is intended to be as space efficient as possible. Different items of Apple equipment require different sized slots, meaning that the security mechanism must provide a variety of different sized tabs. The tabs, once inserted, cannot be removed without damage to the equipment, meaning that the security system cannot be moved from one computer to the other. Even Apple computers with specially designed slots are typically used with peripheral equipment which does not have them, and, the Kensington system provides screws requiring a special screwdriver which replace the screws used to attach the existing communication cables, securing the peripheral equipment to the base computer by preventing unauthorized removal of the communication cables. This last aspect of the system has a drawback in that the peripheral equipment cannot be removed from the base computer without the special screwdriver, which can be lost or misplaced.

Other vendors provide security systems which are not required to interface directly with special slots and capture mechanisms as provided in certain Apple computers. For example, Secure-It, Inc., under the trademark "KĂBLIT", provides a variety of brackets attached to the computer component using existing mounting screws, i.e., screws which are already used to secure items of equipment within the cabinet. Typically, the bracket is apertured so that passage of the cable through the aperture prevents access to the mounting screw and thus prevents removal of the bracket from the equipment. A deficiency of this type of system is that it requires the removal of the existing mounting screw, which may cause some damage to the internal components of the computer. Suitable existing screws are not always available on certain peripherals for convenient attachment of the fastener. For this latter reason, KĂBLIT also provides glue-on disks which, unfortunately, are permanently secured to the equipment.

The theft of small but expensive equipment such as desktop computers is a growing problem. Existing devices are simply too inefficient or ineffective, or their application is too limited. As a result, the use of such security systems is rare, computer equipment is typically left unprotected, and it is all too often stolen.

SUMMARY OF THE INVENTION

The present invention provides a simple yet efficient solution to the prior art problem of inhibiting theft of portable equipment. Specifically, the present invention discloses lock interfaces for a specially designed slot having predetermined dimensions and methods of providing a locking interface to a specially designed slot.

According to a preferred embodiment of the invention, a lock interface includes an anchor spindle and a locking spindle. The anchor spindle includes a neck portion and a head portion, and the locking spindle includes a locking pin. The head portion is adapted for insertion and removal from the specially designed slot when the head portion is aligned with the slot, with the locking pin adapted for insertion and removal from the slot after misaligning the head portion with the slot.

In operation, a user aligns the head portion with the slot, inserts the head portion into the slot, and then misaligns the head portion with the slot. The user then inserts the locking spindle into the slot, thereby inhibiting re-alignment of the head portion with the slot.

Alternative embodiments of the invention include: a lock interface with a first leg and an optional second leg, each having flanges that engage the inner surface of the slot in a locked position but not when the legs are in an unlocked position, and a spacer is interposed between the legs inhibiting the legs from moving from the locked position to the unlocked position; and a lock interface with a first and second legs as above and including a first handle, a second handle, and a retainer coupled to the handles inhibiting the legs from moving from the locked position to the unlocked position.

The preferred embodiment of the invention includes a method of attaching a locking interface to a slot in a computer device having the steps of: aligning a head portion of an anchor spindle with the slot, inserting the head portion into the slot, mis-aligning the head portion with the slot to inhibit removal of the head portion from the slot, and inserting a locking pin of a locking spindle into the slot to inhibit the head portion from aligning with the slot.

Further understanding of the nature and advantages of the invention may be realized by reference to the remaining portions of the Specification and Drawings. In the drawings, similarly numbered items represent the same or functionally equivalent structures.

DETAILED DESCRIPTION OF SPECIFIC EMBODIMENTS

Figure 1:
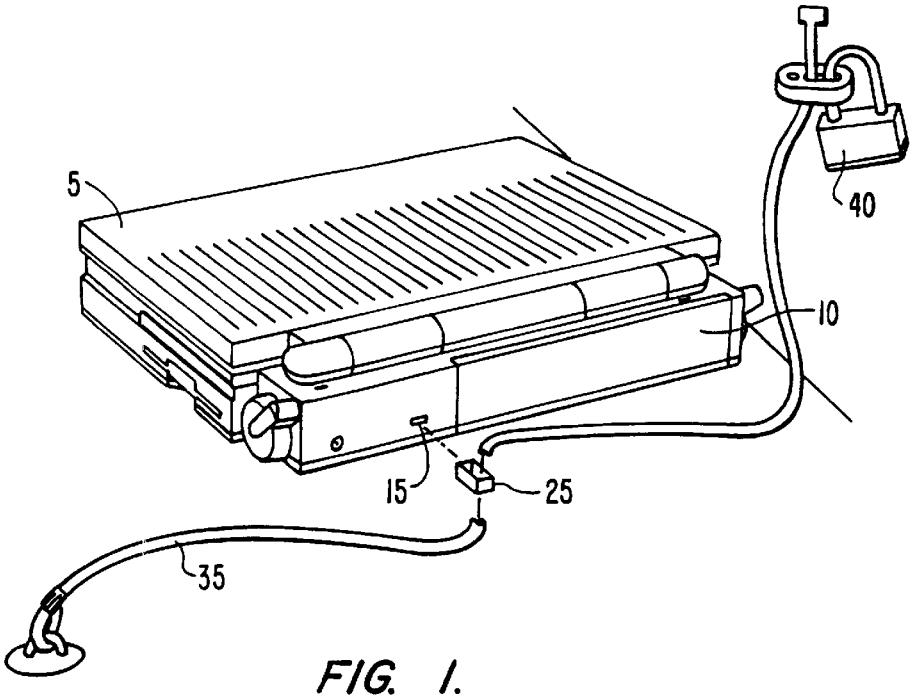
FIG. 1 illustrates a typical use of an embodiment of the present invention.

FIG. 1 illustrates a typical use of an embodiment of the present invention. A portable computer 5 has a wall 10 provided with a slot 15. Wall 10 includes an inner surface 20. A lock interface 25 is engageable with wall 10 through slot 15. A locking mechanism 30, according to the preferred embodiment, includes a cable 35 and a lock 40. In operation, a user inserts lock interface 25 into slot 15 and engages lock interface 25 with inner surface 20. Once engaged, a user can attach lock interface 25 to a stationary object with cable 35 and lock 40. Locking mechanism 30 may include other objects, such as a shackle of padlock coupling a cable to the stationary object.

Figure 2:
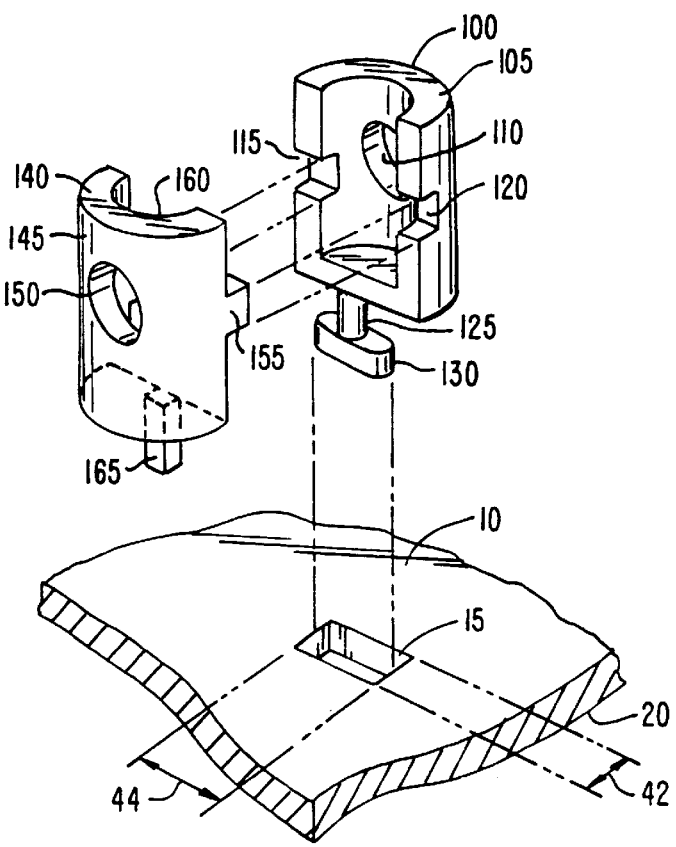
FIG. 2 is a perspective view of an embodiment of the present invention.

FIG. 2 is a perspective view of an embodiment of the present invention including a lock interface 25. Slot 15 has a small dimension 42 and a large dimension 44. Lock interface 25 includes an anchor spindle 100 having a body portion 105. Body portion 105 includes an aperture 110, two engagement members (engagement member 115 and engagement member 120), a neck portion 125, and a head portion 130. Neck portion 125 has a length exceeding a thickness of wall 10, enabling head portion 130 to be fully inserted into slot 15. In the preferred embodiment, head portion 130 preferably has a shape conforming to slot 15. Lock interface 25 also includes a locking spindle 140 having a body portion 145. Body portion 145 includes an aperture 150, two engagement members (engagement member 155 and engagement member 160), and a locking pin 165.

Figure 3:
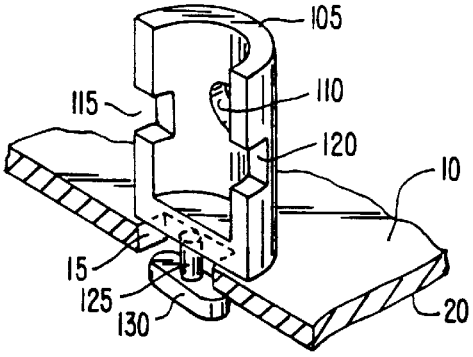
FIG. 3 is a perspective view illustrating the head portion of an embodiment of the present invention aligned and inserted into the slot.
Figure 4:
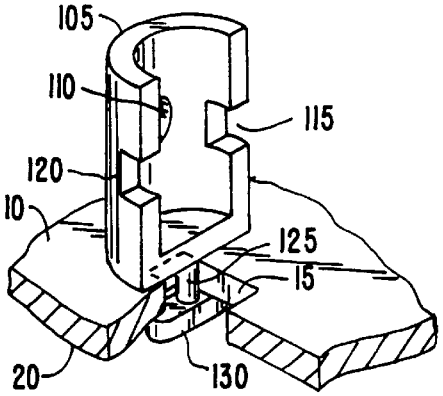
FIG. 4 is another perspective view illustrating the head portion of an embodiment of the present invention inserted and misaligned with the slot.
Figure 5:
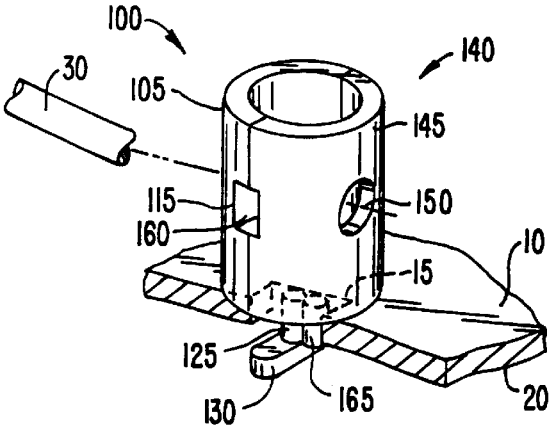
FIG. 5 is a perspective view illustrating the head portion of an embodiment of the present invention engaging the inner surface and the locking pin inserted in the slot.

In operation, a user aligns head portion 130 with slot 15 and inserts head portion 130 into slot 15. FIG. 3 is a perspective view illustrating head portion 130 of an embodiment of the present invention aligned and inserted into slot 15. FIG. 4 is another perspective view illustrating head portion 130 of an embodiment of the present invention inserted and misaligned with slot 15. Mis-aligning head portion 130 with slot 15 engages head portion 130 with inner surface 20 of wall 10, thereby inhibiting removal of lock interface 25 from computer 5. Subsequent insertion of locking pin 165 into slot 15 inhibits re-alignment of head portion 130 with slot 15. FIG. 5 is a perspective view illustrating head portion 130 of an embodiment of the present invention engaging inner surface 20 and locking pin 165 inserted into slot 15. Engaging engagement member 115 with engagement member 160, and engagement member 120 with engagement member 155 (not shown) engages anchor spindle 100 with locking spindle 160. In the preferred embodiment, the size of neck portion 125 together with locking pin 165 exceeds small dimension 42 of slot 15, inhibiting rotation of locking spindle 140 and anchor spindle 100 together as a unit into slot 15, thereby inhibiting realignment of head portion 130 with slot 15. Inserting a locking mechanism 30 through aperture 110 and aperture 150 maintains the engagement of anchor spindle 100 with locking spindle 140, and can be used to lock the computer 5 to a stationary object.

Figure 6:
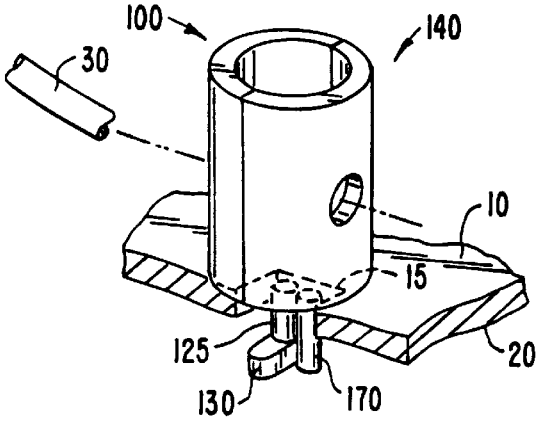
FIG. 6 is a lock interface that is an alternative embodiment to the lock interface shown in FIGS. 2–5.

FIG. 6 is a lock interface that is an alternative embodiment to the lock interface shown in FIGS. 2–5. Lock interface 50 does not have engagement members 115, 120, 155, or 160 on anchor spindle 100 or locking spindle 140. Lock interface 50 includes a locking pin 170 that has a depth at least equal to the depth of neck portion 125 including head portion 130.

In operation, a user aligns head portion 130 with slot 15 and inserts head portion 130 into slot 15. Misaligning head portion 130 with slot 15 engages head portion 130 with inner surface 20 of wall 10, thereby inhibiting removal of lock interface 50 from computer 5. Subsequent insertion of a locking pin 165 into slot 15 inhibits realignment of head portion 130.

Figure 7:
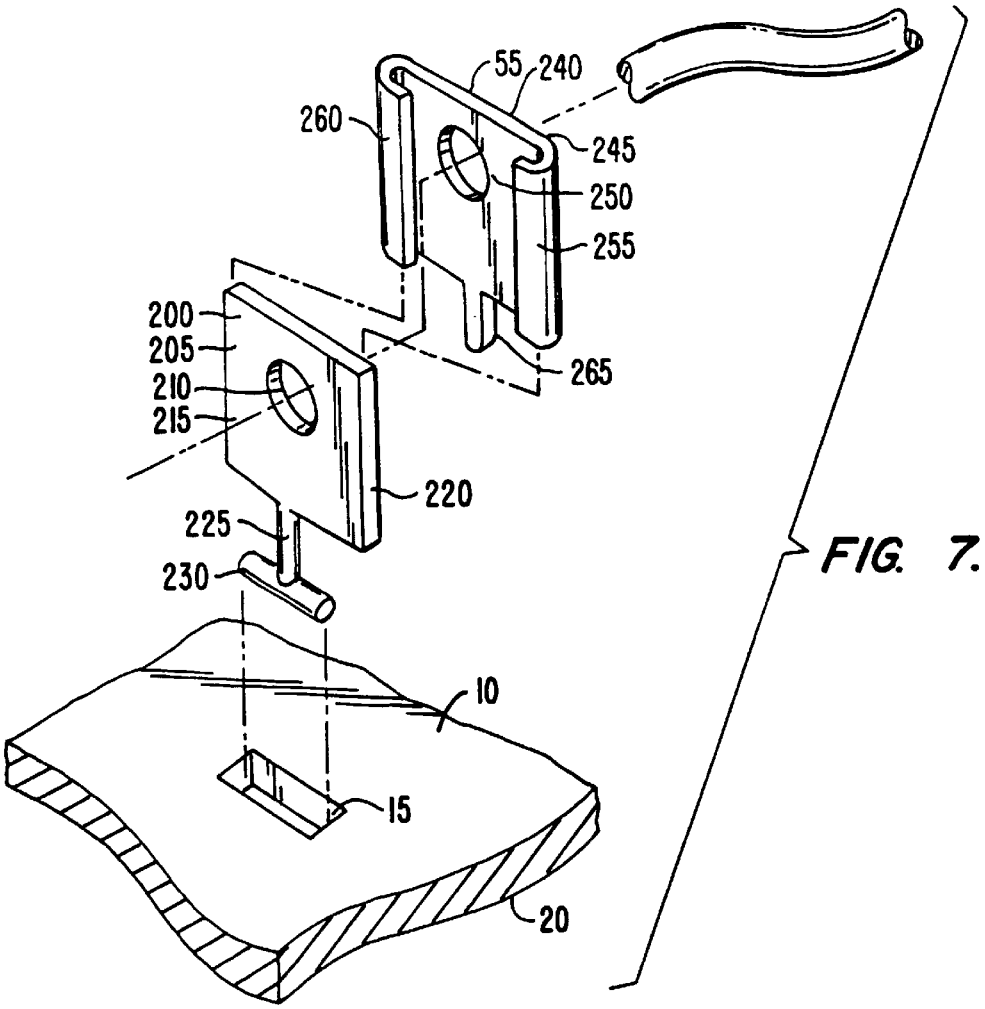
FIG. 7 illustrates another embodiment of a lock interface.

In the preferred embodiment, the locking pin 170 physically inhibits rotation of head portion 130 within slot 15, thereby inhibiting re-alignment of head portion 130 with slot 15. Inserting a locking mechanism 30 through aperture 110 and aperture 150 maintains insertion of locking pin 165 and head portion 130 into slot 15, and can be used to lock the computer 5 to a stationary object FIG. 7 illustrates another embodiment of a lock interface 55. Lock interface 55 includes an anchor spindle 200 having a body portion 205. Body portion 205 includes an aperture 210, two engagement members (engagement member 215 and engagement member 220), a neck portion 225, and a head portion 230. The vertical sides of anchor spindle 200 form engagement member 215 and engagement member 220. Neck portion 225 has a length exceeding the thickness of wall 10 enabling head portion 230 to be fully inserted into slot 15. Head portion 230 preferably has a shape conforming to slot 15. Lock interface 55 also includes a locking spindle 240 having a body portion 245. Body portion 245 includes an aperture 250, two engagement members (engagement member 255 and engagement member 260), and a locking pin 265. The curved portions of locking spindle 240 form engagement member 255 and engagement member 260.

In operation, a user aligns head portion 230 with slot 15 and inserts head portion 230 into slot 15. Misaligning head portion 230 with slot 15 engages head portion 230 with inner surface 20 of wall 10, thereby inhibiting removal of lock interface 55 from computer 5. Subsequent insertion of locking pin 265 into slot 15 inhibits realignment of head portion 230 with slot 15. Sliding engagement member 220 over engagement member 255 and engagement member 215 over engagement member 260 engages locking spindle 240 with anchor spindle 200.

In the preferred embodiment, the size of neck portion 223 together with locking pin 265 exceed smaller dimension 42 of slot 15, inhibiting rotation of locking spindle 240 and anchor spindle 200 together as a unit within slot 15, thereby inhibiting re-alignment of head portion 230 with slot 15. Inserting a locking mechanism 30 through aperture 210 and aperture 250, maintains the engagement of anchor spindle 200 with locking spindle 240, and can be used to lock the computer 5 to a stationary object.

Figure 8:
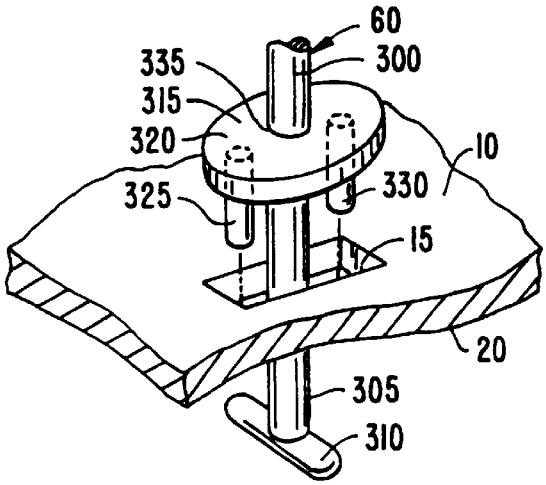
FIG. 8 illustrates another embodiment of a lock interface.

FIG. 8 illustrates another embodiment of a lock interface 60. Lock interface 60 includes an anchor spindle 300 having a neck portion 305 and a head portion 310. Head portion 310 preferably has a shape conforming to slot 15. Lock interface 60 also includes a locking spindle 315 having a body portion 320. Body portion 320 includes two locking pins (locking pin 325 and locking pin 330), and an engagement aperture 335. Neck portion 305 is adapted to engage locking spindle 335.

In operation, a user aligns head portion 310 with slot 15 and inserts head portion 310 into slot 15. Subsequent insertion of neck portion 305 through engagement aperture 335 allows movement of locking spindle 315 down neck portion 305 until locking pin 325 and locking pin 330 protrude into slot 15. Mis-aligning head portion 310 with slot 15, engages head portion 310 with inner surface 20 thereby inhibiting removal of lock interface 60 from computer 5. Attaching a locking mechanism 30 to anchor spindle 300 maintains engagement of head portion 310 with inner surface 20, and can be used to lock the computer 5 to a stationary object.

An alternative embodiment of the invention shown in FIG. 8, the locking spindle 315 may include a single locking pin 325.

Figure 9:
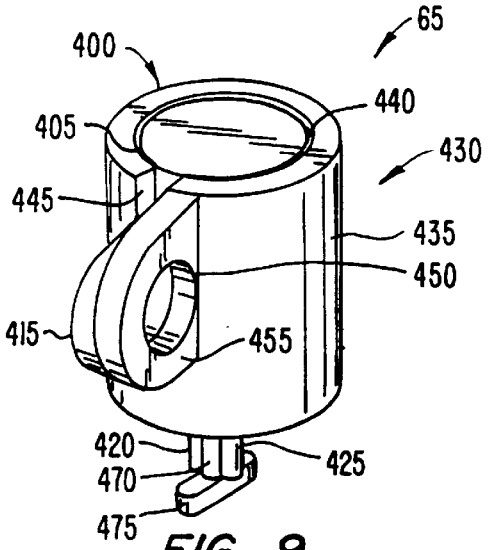
FIG. 9 illustrates another embodiment of a lock interface.
Figure 10:
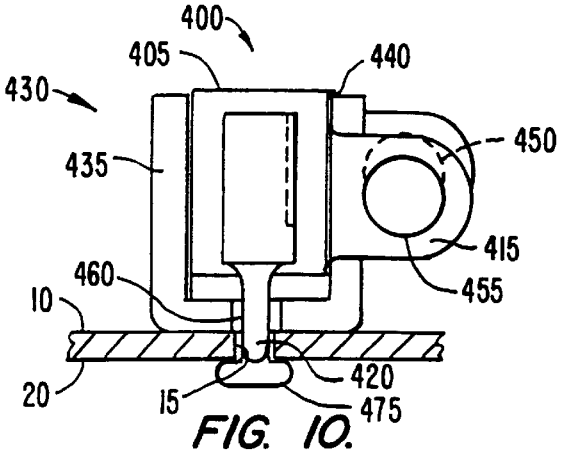
FIG. 10 is an elevation of FIG. 9. illustrating the head portion engaging the inner surface and the locking pin inserted into the slot.

FIG. 9 illustrates another embodiment of a lock interface 65. Lock interface 65 includes a locking spindle 400 having a cylindrical shaped body 405. Cylindrical shaped body 405 includes an aperture 410 in an engagement handle 415, and two locking pins (locking pin 420 and locking pin 425). Lock interface 65 also includes an anchor spindle 430 having a hollow cylindrical shaped body 435. Hollow cylindrical shaped body 435 includes a central cavity 440, an engagement slot 445, an aperture 450 in a handle 455, two locking pin apertures, locking pin aperture 460 and locking pin aperture 465 (not shown), a neck portion 470, and a head portion 475. Neck portion 470 has a length exceeding the thickness of wall 10 enabling head portion 470 to be fully inserted into slot 15. Head portion 475 has a shape conforming to slot 15 in dimensions. FIG. 10 is an elevation of FIG. 9. illustrating head portion 470 engaging inner surface 20 and locking pin 420 inserted into slot 15.

Locking spindle 400 is inserted in central cavity 440 with engagement handle 415 slidably insertable into engagement slot 445. Anchor spindle 430 is adapted to allow locking spindle 400 to move co-axially within anchor cavity 440 towards and away from head portion 475 so as to insert and withdraw locking pin 420 and locking pin 425 from locking pin aperture 460 and locking pin aperture 465.

In operation, a user aligns head portion 475 with slot 15 and inserts head portion 475 into slot 15. Aligning locking pin aperture 460 and locking pin aperture 465 with slot 15 mis-aligns head portion 475 with slot 15, thereby engaging head portion 475 with inner surface 20 and inhibiting removal of lock interface 65 from computer 5. Subsequent insertion of locking spindle 400 into central cavity 440 and insertion of engagement handle 415 in engagement slot 445, moves locking spindle 400 co-axially in central cavity 440 towards wall 10 until locking pin 420 protrudes through locking pin aperture 460 and into slot 15 and until locking pin 425 protrudes through locking pin aperture 465 and into slot 15.

In the preferred embodiment, the size of neck portion 470 together with locking pin 420 exceed smaller dimension 42 of slot 15, inhibiting rotation of locking spindle 400 and anchor spindle 430 within slot 15, thereby inhibiting re-alignment of head portion 475 with slot 15. Locking a locking mechanism 30 through aperture 410 and aperture 450 maintains the engagement of locking spindle 400 to anchor spindle 430, and can be used to lock the computer 5 to a stationary object.

Figure 11:
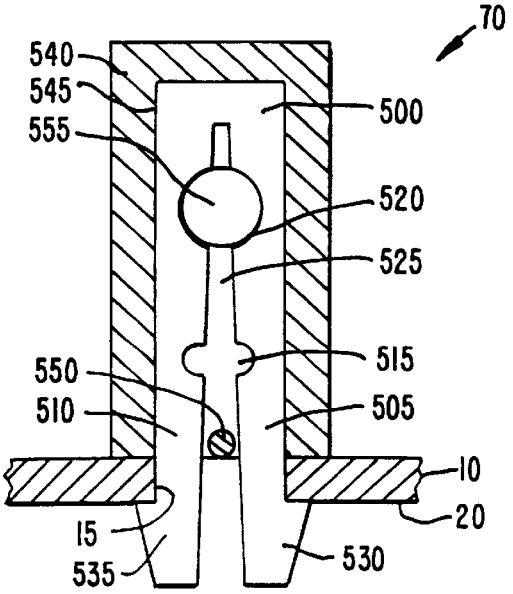
FIG. 11 illustrates another embodiment of a lock interface.

FIG. 11 illustrates another embodiment of a lock interface 70. Lock interface 70 includes an engagement member 500. Engagement member 500 includes a first leg 505, a second leg 510, a first aperture 515 between first leg 505 and second leg 510, a second aperture 520 between first leg 505 and second leg 510, and a space 525 between first leg 505 and second leg 510. First leg 505 includes a flange 530 at a distal end that is flanged away from second leg 510, and second leg 510 includes a flange 535 at a distal end that is flanged away from first leg 505. Lock interface 70 also includes a retainer 540. Retainer 540 includes a cavity 545, a spacer 550, and an aperture 555.

Figure 12:
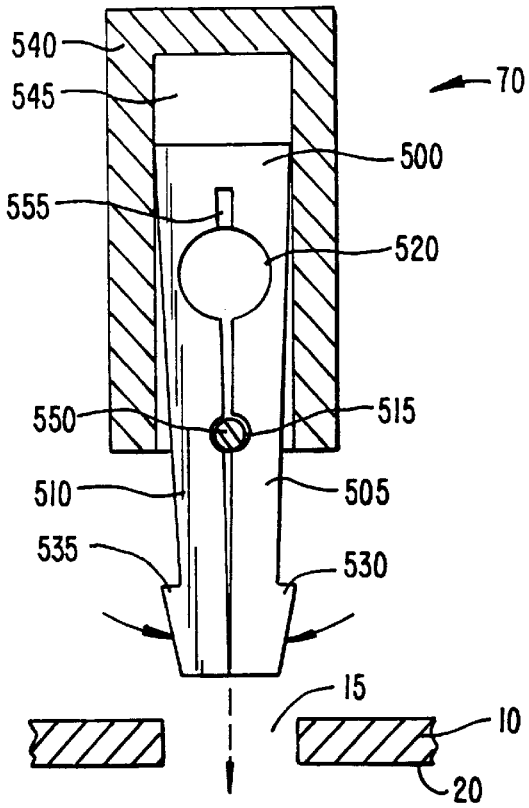
FIG. 12 is another view of the lock interface in FIG. 11 with the first leg and the second leg in the first position.

Engagement member 500 is slidably disposed within cavity 545 with spacer 550 being fixed in relation to retainer 540. Spacer 550 is small enough to freely slide within space 525, but is large enough to inhibit first leg 505 and second leg 510 from being squeezed together as illustrated in FIG. 11. When spacer 550 is located at first aperture 515 or second aperture 520, first leg 505 and second leg 510 can be squeezed together. This squeezed position defines a first position, and the unsqueezed position defines a second position. FIG. 12 is another view of the lock interface in FIG. 11 with first leg 505 and second leg 510 in the first position. When first leg 505 and second leg 510 are in the first position, flange 530 and flange 535 are insertable and removable from the slot 15. FIG. 11 illustrates that when first leg 505 and second leg 510 are in the second position, flange 530 and flange 535 are engageable with inner surface 20.

In operation, a user withdraws engagement member 500 from cavity 545 until spacer 550 is located at first aperture 515 (or second aperture 520). Squeezing first leg 505 and second leg 510 together moves first leg 505 and second leg 510 into the first position, allowing insertion of flange 530 and flange 535 into slot 15. Returning first leg 505 and second leg 510 to the second position allows flange 530 and flange 535 to engage inner surface 20. Subsequent movement of retainer 545 towards wall 10 until retainer 545 abuts wall 10, locates spacer 550 in space 525 but not within first aperture 515 or second aperture 520 and co-aligns aperture 555 with second aperture 520. In the preferred embodiment, locating spacer 550 in space 525 but not within first aperture 515 or second aperture 520, inhibits moving first leg 505 and second leg 510 into the first position. Locking a locking mechanism 30 through aperture 555 and second aperture 520 maintains the engagement of engagement member 500 with inner surface 20, and can be used to lock the computer 5 to a stationary object.

Figure 13:
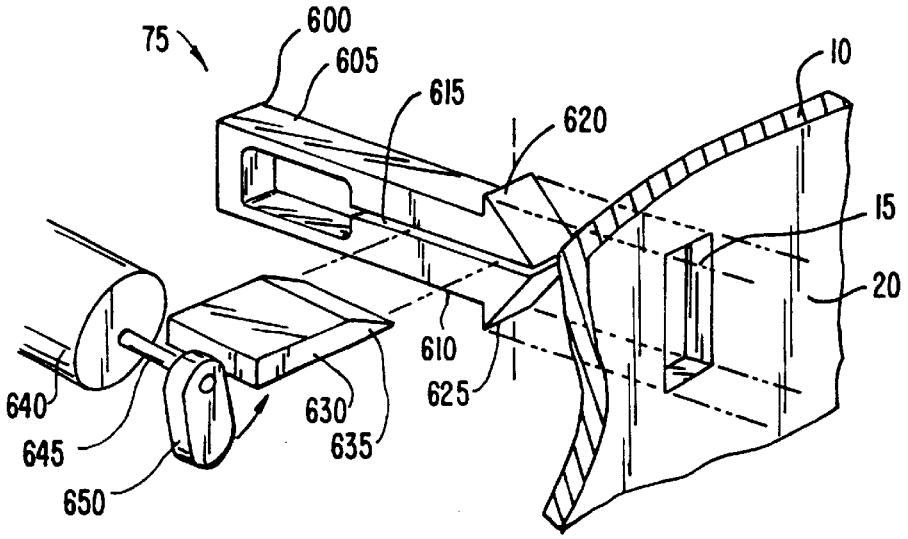
FIG. 13 illustrates another embodiment of lock interface.

FIG. 13 illustrates another embodiment of lock interface 75. Lock interface 75 includes an engagement member 600. Engagement member 600 includes a first leg 605, a second leg 610, and a space 615 between first leg 605 and second leg 610. First leg 605 includes a flange 620 at a distal end that is flanged away from second leg 610, and second leg 610 includes a flange 625 at a distal end that is flanged away from first leg 605. Lock interface 75 also includes a spacer 630 having a ramped portion 635, and a spacer mover 635. Spacer mover 635 includes a housing 640, a rotatable shaft 645, a cam 650, and an aperture 655.

Figure 14:
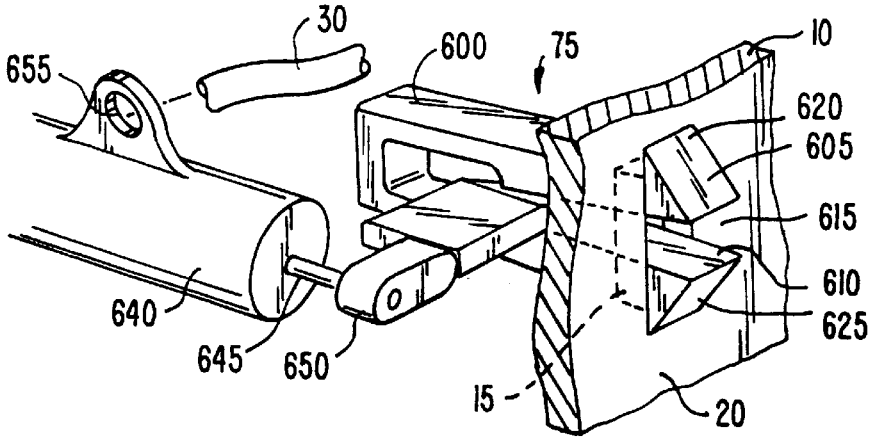
FIG. 14 is another view of the lock interface in FIG. 13 with the first leg and the second leg in the second position.
Figure 15:
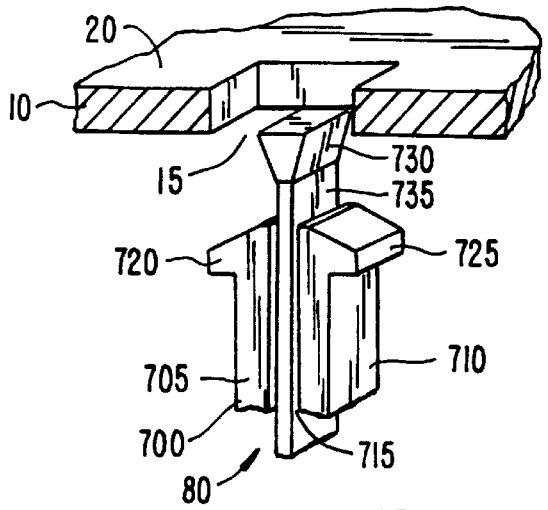
FIG. 15 illustrates another embodiment of lock interface.

Spacer 630 is slidably disposable within space 615 by the movement of cam 650. When spacer 630 is not disposed between first leg 605 and second leg 610, this default position defines a first position, and when spacer 630 is disposed between first leg 605 and second leg 610 the position defines a second position. FIG. 13 illustrates that when first leg 605 and second leg 610 are in the first position, flange 620 and flange 625 are insertable and removable from the slot 15. FIG. 14 is another view of the lock interface in FIG. 13 with first leg 605 and second leg 610 in the second position. When first leg 605 and second leg 610 are in the second position, flange 620 and flange 625 are engagable with inner surface 20. A ramped portion 635 of spacer 630 is used to smoothly move first leg 605 and second leg 610 from the first position to the second position.

In operation, when first leg 605 and second leg 610 are in the first position, a user inserts flange 620 and flange 625 into slot 15. Rotating rotatable shaft 645 relative to housing 640 causes cam 650 to insert spacer 630 into space 615 which causes first leg 605 and second leg 610 to move into the second position. When first leg 605 and second leg 610 reach the second position, flange 620 and flange 625 engage inner surface 20. Locking a locking mechanism 30 through aperture 655 maintains the engagement of engagement member 600 with inner surface 20, and can be used to lock the computer 5 to a stationary object.

FIG. 14 illustrates another embodiment of lock interface 80. Lock interface 80 includes an engagement member 700. Engagement member 700 includes a first leg 705, a second leg 710, and a space 715 between first leg 705 and second leg 710. First leg 705 includes a flange 720 at a distal end that is flanged away from second leg 710, and second leg 710 includes a flange 725 at a distal end that is flanged away from first leg 705. Lock interface 80 also includes a spacer 730 and a shaft 735.

Figure 16:
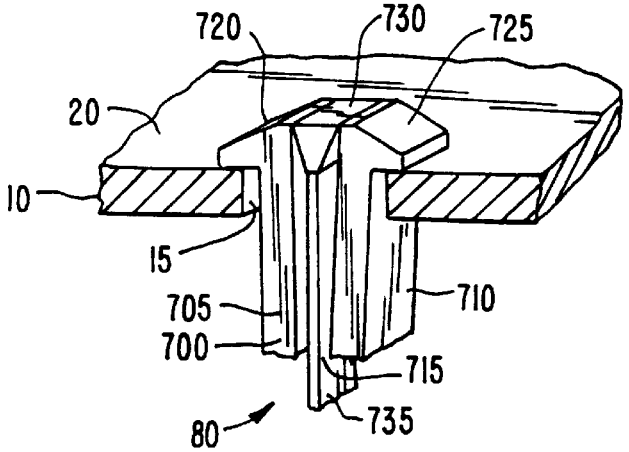
FIG. 16 is another view of the lock interface in FIG. 15 with the first leg and the second leg in the second position.

Spacer 730 is slidably disposable within space 715 in response to the movement of shaft 735 in space 715. When spacer 730 is not disposed between first leg 705 and second leg 710, this default position defines a first position, and when spacer 730 is disposed between first leg 705 and second leg 710 the position defines a second position. FIG. 14 illustrates that when first leg 705 and second leg 710 are in the first position, flange 720 and flange 725 are insertable and removable from the slot 15. FIG. 16 is another view of the lock interface in FIG. 14 with first leg 705 and second leg 710 in the second position. When first leg 705 and second leg 710 are in the second position, flange 720 and flange 725 are engageable with inner surface 20.

In operation, when first leg 705 and second leg 710 are in the first position, a user inserts spacer 730, flange 720, and flange 725 into slot 15. Withdrawing shaft 735 partially from slot 15 while maintaining the position of first leg 705 and second leg 710 to the slot 15, forces spacer 730 into space 715 which causes first leg 705 and second leg 710 to move into the second position. When first leg 705 and second leg 710 reach the second position, flange 720 and flange 725 engage inner surface 20.

Figure 17:
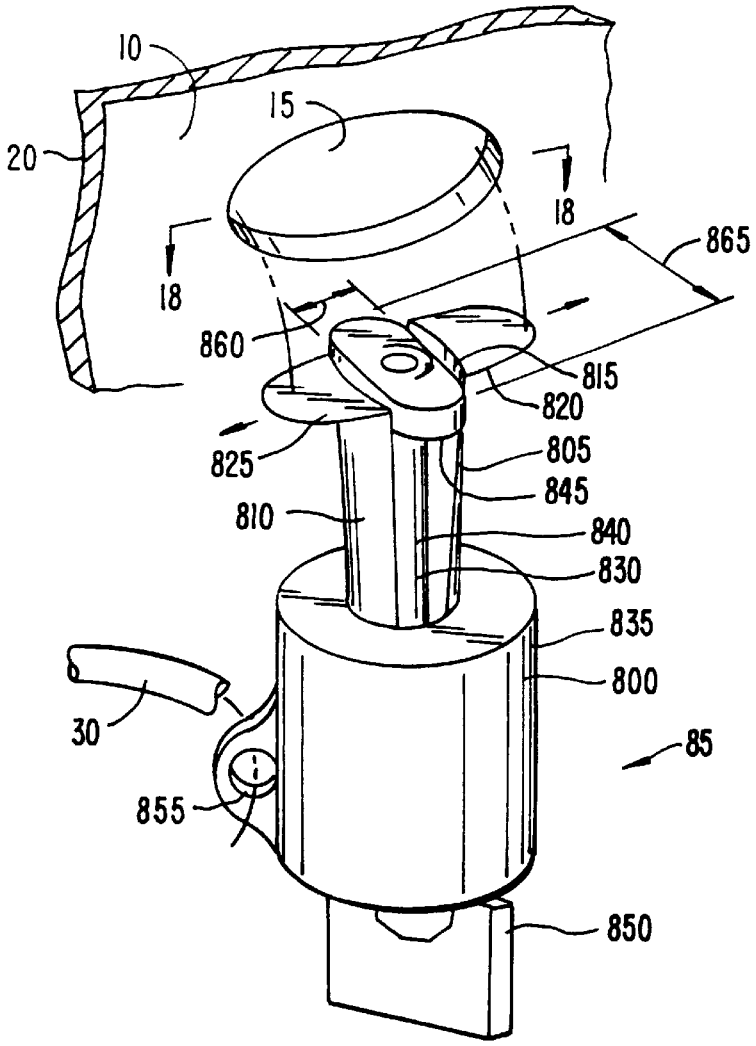
FIG. 17 illustrates another embodiment of a lock interface.

FIG. 17 illustrates another embodiment of a lock interface 85. Lock interface 85 includes an engagement member 800. Engagement member 800 includes a first leg 805, a second leg 810, and a space 815 between first leg 805 and second leg 810. First leg 810 includes a flange 820 at a distal end that is flanged away from second leg 810, and second leg 810 includes a flange 825 at a distal end that is flanged away from first leg 805. Lock interface 85 also includes a spacer mechanism 830. Spacer mechanism 830 includes a housing 835, a shaft 840, a head portion 845, a removable knob 850, and an aperture 855. Head portion 845 is oval in shape and has a smaller diameter 860 and a larger diameter 865.

Figure 18:
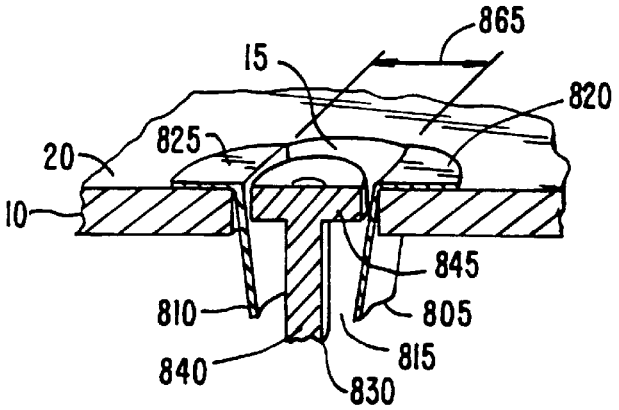
FIG. 18 is another view of the lock interface in FIG. 17 with the first leg and the second leg in the second position.

First leg 805 and second leg 810 are fixed to housing 835 with shaft 840 and head portion 845 rotatably interspersed in space 815 between first leg 805 and second leg 810. When smaller diameter 860 is interposed between first leg 805 and second leg 810, the position defines a first position, and when larger diameter 865 is interposed between first leg 805 and second leg 810, the position defines a second position. FIG. 18. illustrates that when first leg 805 and second leg 810 are in the first position, flange 820 and flange 825 are insertable and removable from the slot 15. FIG. 18 is another view of the lock interface in FIG. 17 with first leg 805 and second leg 810 in the second position. When first leg 805 and second leg 810 are in the second position, flange 820 and flange 825 are engageable with inner surface 20. Smaller diameter 860 and larger diameter 865 of head portion 845 are interposed between first leg 805 and second leg 810 by rotating removable knob 850 relative to housing 835. Rotating removable knob 850 causes shaft 840 and head portion 845 to rotate relative to first leg 805 and second leg 810.

In operation, when first leg 805 and second leg 810 are in the first position, a user inserts head portion 845, flange 820, and flange 825 into slot 15. Rotating removable knob 850, shaft 840, and head portion 845 relative to housing 835 causes larger diameter 865 to be interposed between first leg 805 and second leg 810 and causes first leg 805 and second leg 810 to move into the second position. When first leg 805 and second leg 810 reach the second position, flange 820 and flange 825 engage inner surface 20. Removing removable knob 850 and locking a locking mechanism 30 through aperture 855 maintains the engagement of engagement member 800 with inner surface 20, and can be used to lock the computer 5 to a stationary object.

Figure 19:
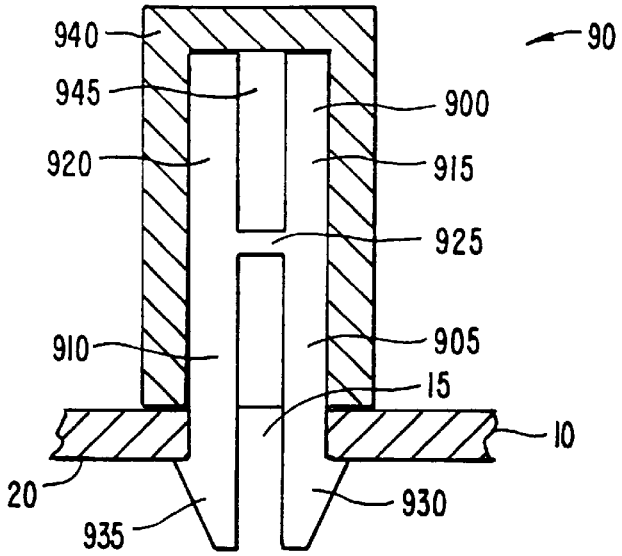
FIG. 19 illustrates another embodiment of lock interface.

FIG. 19 illustrates another embodiment of lock interface 90. Lock interface 90 includes an engagement member 900.

Engagement member 900 includes a first leg 905, a second leg 910, a first handle 915, a second handle 920, and an articulation point 925. First leg 905 includes a flange 930 at a distal end that is flanged away from second leg 910, and second leg 910 includes a flange 935 at a distal end that is flanged away from first leg 905. Lock interface 90 also includes a retainer 940 having a cavity 945.

Figure 20:
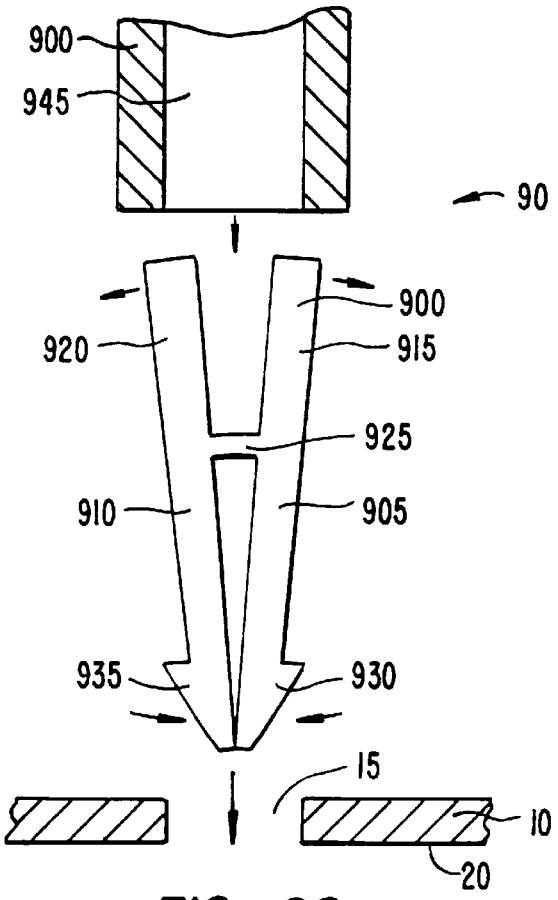
FIG. 20 is another view of the lock interface in FIG. 19 with the first leg and the second leg in the first position.

First leg 905 and second leg 910 are coupled to each other at articulation point 925. When first leg 905 and second leg 910 move towards each other, defining a first position, first handle 915 and second handle 920 are moved away from each other, and when first handle 915 and second handle 920 are moved towards each other, first leg 905 and second leg 910 move away from each other, defining a second position. FIG. 20 is another view of the lock interface in FIG. 19 with first leg 905 and second leg 910 in the first position. When first leg 905 and second leg 910 are in the first position, flange 930 and flange 935 are insertable and removable from slot 15. FIG. 19 illustrates that when first leg 905 and second leg 910 are in the second position, flange 930 and flange 935 are engageable with inner surface 20.

In operation, a user squeezes first leg 905 and second leg 910 into the first position, and inserts flange 930 and flange 935 into slot 15. Returning first leg 905 and second leg 910 to the second position allows engaging flange 930 and flange 935 with inner surface 20. Subsequent movement of retainer 940 towards wall 10 until retainer 545 abuts wall 10, prevents access to engagement member 900. In the preferred embodiment, access to first leg 905, second leg 910, first handle 915 and second handle 920 is prevented, maintaining the second position of first leg 905 and second leg 910, thereby maintaining the engagement of flange 930 and flange 935 with inner surface 20.

Figure 21:
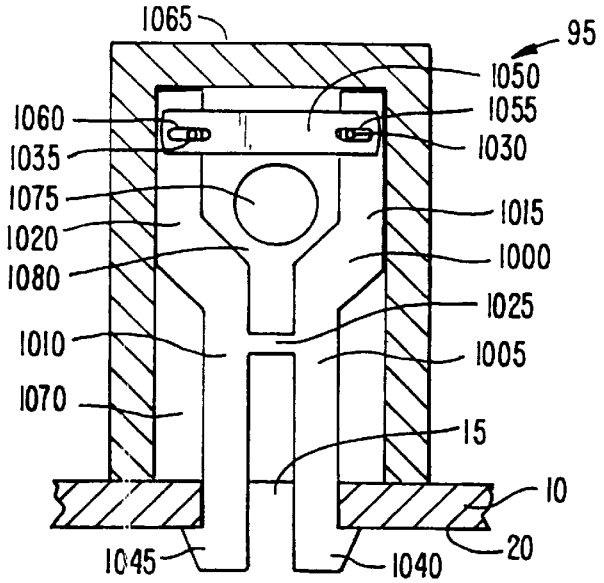
FIG. 21 illustrates another embodiment of lock interface.

FIG. 21 illustrates another embodiment of lock interface 95. Lock interface 95 includes an engagement member 1000. Engagement member 1000 includes a first leg 1005, a second leg 1010, a first handle 1015, a second handle 1020, and an articulation point 1025. First handle 1015 includes a retaining pin 1030, and second handle 1020 includes a retaining pin 1035. First leg 1005 includes a flange 1040 at a distal end that is flanged away from second leg 1010, and second leg 1010 includes a flange 1045 at a distal end that is flanged away from first leg 1005. Lock interface 95 also includes a retaining clip 1050 having a first aperture 1055 and a second aperture 1060 and a retainer 1065 having a cavity 1070 and an aperture 1075. Retaining clip 1050, first handle 1015, and second handle 1020 together define an aperture 1080.

Figure 22:
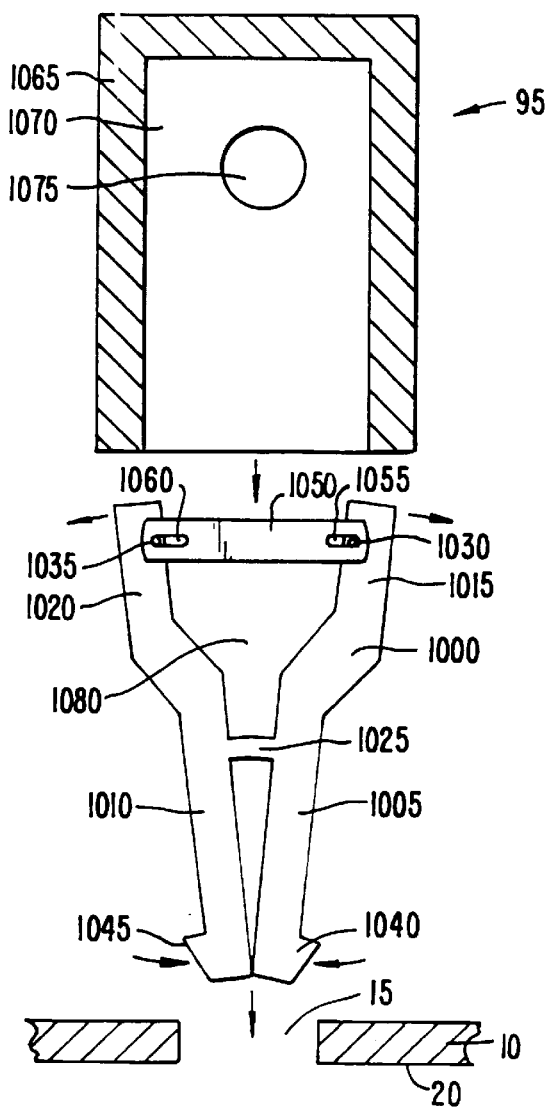
FIG. 22 is another view of the lock interface in FIG. 21 with the first leg and the second leg in the second position.

Retaining pin 1025 and retaining pin 1030 are inserted into first aperture 1055 and into second aperture 1060, respectively. Retaining clip 1050 limits the range of motion of first handle 1015 and second handle 1020. First leg 1005 and second leg 1010 are coupled to each other at articulation point 1025. When first leg 1005 and second leg 1010 move towards each other, defining a first position, first handle 1015 and second handle 1020 are moved away from each other, and when first handle 1015 and second handle 1020 are moved towards each other, first leg 1005 and second leg 1010 move away from each other, defining a second position. FIG. 21 illustrates that when first leg 1005 and second leg 1010 are in the first position, flange 1040 and flange 1045 are insertable and removable from slot 15. FIG. 22 is another view of the lock interface in FIG. 21 with first leg 1005 and second leg 1010 in the second position. When first leg 1005 and second leg 1010 are in the second position, flange 1040 and flange 1045 are engageable with inner surface 20.

In operation, a user squeezes first leg 1005 and second leg 1010 into the first position, and inserts flange 1040 and flange 1045 into slot 15. Returning first leg 1005 and second leg 1010 to the second position allows engaging flange 1040 and flange 1045 with inner surface 20. Subsequent insertion of engagement member 1000 into cavity 1070 and movement of retainer 1065 until retainer 1065 abuts wall 10, co-aligns aperture 1075 and aperture 1080, and prevents access to engagement member 1000. In the preferred embodiment, access to first leg 1005, second leg 1010, first handle 1015, and second handle 1020 is prevented, maintaining positioning of first leg 1005 and second leg 1010 in the second position, thereby maintaining engagement of flange 1040 and flange 1045 with inner surface 20. Inserting a locking mechanism 30 through aperture 1075 and aperture 1080 maintains positioning of retainer 1065 to engagement member 1000, and can be used to lock the computer 5 to a stationary object.

Figure 23:
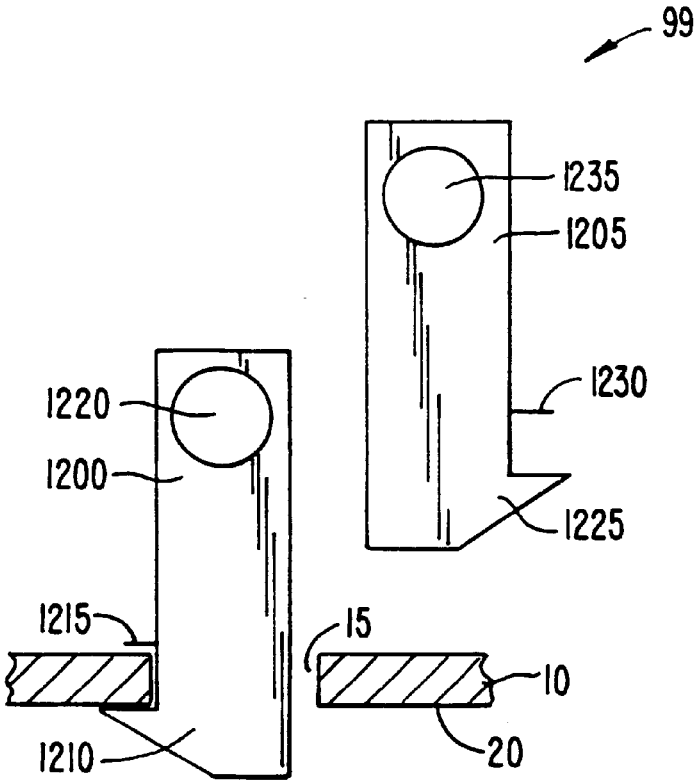
FIG. 23 illustrates another embodiment of a lock interface.

FIG. 23 illustrates another embodiment of a lock interface 99. Lock interface 99 includes a first engagement member 1200 and a second engagement member 1205. First engagement member 1200 includes a flange 1210 at a distal end, a catch 1215, and an aperture 1220. Second engagement member 1205 includes a flange 1225 at a distal end, a catch 1230 and an aperture 1235.

Figure 24:
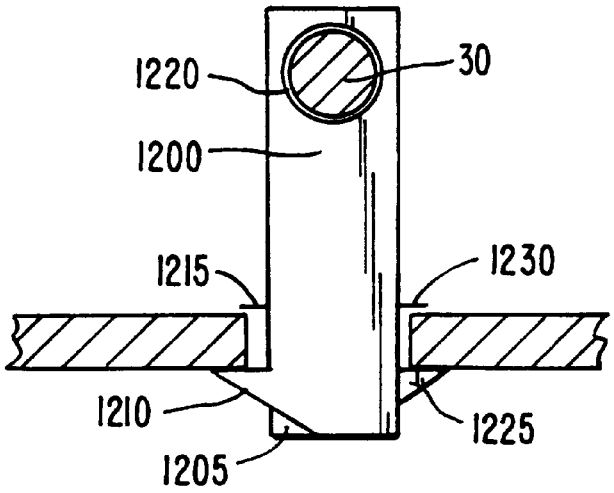
FIG. 24 is another view of the lock interface in FIG. 23 with the flange and the flange engaging the inner surface.

First engagement member 1200 and second engagement member 1205 are independently insertable and removable from slot 15. When inserted into slot 15, flange 1210 and flange 1225 are engageable with inner surface 20. Catch 1215 and catch 1230 inhibit first engagement member 1200 and second engagement member 1205 from being fully inserted into slot 15, respectively. FIG. 23 illustrates flange 1210 of first engagement member 1200 engaging the inner surface 20 whereas second engagement member 1205 has not been inserted from slot 15. FIG. 24 is another view of the lock interface in FIG. 23 with flange 1210 and flange 1225 engaging inner surface 20.

In operation, a user inserts flange 1210 of first engagement member 1200 into slot 15 and engages flange 1210 with inner surface 20. Subsequent insertion of flange 1225 of second engagement member 1205 into slot 15, with flange 1225 pointing in a direction opposite that of flange 1210, engages flange 1225 with inner surface 20. Inserting a locking mechanism 30 through aperture 1210 and 1220 maintains engagement of flange 1210 and flange 1225 with inner surface 20 and can be used to lock the computer 5 to a stationary object.

In the foregoing specification, the invention has been described with reference to a specific exemplary embodiments thereof. It will, however, be evident that various modifications and changes may be made thereunto without departing from the broader spirit and scope of the invention as set forth in the claims.

Many changes or modifications are readily envisioned, for example, changing the shape of the slot and the shape of the head portion, adding catches to the engagement members, and changing the shape of the flanges among other changes. The specification and drawings are, accordingly, to be regarded in an illustrative rather than in a restrictive sense.

We claim:

1. A security lock system, comprising:

a portable electronic device having an external wall defining a security slot;

locking means for attaching to a first object other than to the portable electronic device;

a locking member having a peripheral profile complementary to preselected dimensions of said security slot, said locking member adapted for insertion into and withdrawal from said slot when in a first position and for engagement with an interior surface of said wall when in a second position such that said locking member is associated with said portable device while in said second position;

a pin adapted for insertion into and withdrawal from said slot when said locking member is in said second position, said pin inhibiting transition of said locking member from said second position to said first position; and means, coupled to said pin, for attaching to said locking means and for inhibiting removal of said pin from said slot.

2. The security lock of claim 1 wherein said peripheral profile matches said security slot.

3. A security lock system, comprising:

a portable electronic device having an external wall defining a security slot;

a locking member having a peripheral profile complementary to preselected dimensions of said security slot, said locking member adapted for insertion into and withdrawal from said slot when in a first position and for engagement with an interior surface of said wall when in a second position such that said locking member is associated with said portable device while in said second position;

a pin adapted for insertion into and withdrawal from said slot when said locking member is in said second position, said pin inhibiting transition of said locking member from said second position to said first position; and pin retaining means coupled to said pin for inhibiting removal of said pin from said slot.

4. The security lock of claim 3 further comprising:

a cable attachment mechanism for associating a cable with the engagement member.

5. The security lock of claim 1 wherein said security slot is rectangular having a length dimension greater than a width dimension.

6. The security lock of claim 1 wherein said locking means is a cable and lock.

7. The security lock of claim 6 wherein said means for attaching to said locking means further comprises a cable attachment mechanism for associating said pin with said cable.

8. The security lock of claim 3 wherein said security slot is rectangular having a length dimension greater than a width dimension.

9. A security lock system, comprising:

a portable electronic device having an external wall defining a security slot;

a locking spindle having a body portion and a head portion, said head portion having a peripheral profile complementary to said security slot, said head portion adapted for insertion into and withdrawal from said slot when in a first position and for engagement with an interior surface of said wall when in a second position such that said head portion is associated with said portable device while in said second position;

an anchor spindle having a body portion and an anchor portion, said anchor portion adapted for insertion into and withdrawal from said slot when said head portion of the locking spindle is in said second position, said anchor portion inhibiting transition of said head portion from said second position to said first position, and said anchor spindle body portion adapted for association with said locking spindle body portion; and a locking mechanism, adapted for engaging said anchor spindle body portion and said locking spindle body portion, inhibiting disassociation of said locking spindle and said anchor spindle.

10. The security lock of claim 9 wherein said anchor spindle body portion has at least one engagement member adapted for engaging said anchor spindle body portion to said locking spindle body portion.

11. The security lock of claim 9 wherein said security slot is rectangular having a length dimension greater than a width dimension.

12. The security lock of claim 9 wherein said locking mechanism is a cable for attaching to an object other than to said portable electronic device.

* * * * *

US006006557C1

(12) EX PARTE REEXAMINATION CERTIFICATE (7513th)

United States Patent

Carl et al.

(10) Number: US 6,006,557 C1

(45) Certificate Issued: *May 18, 2010

(54) COMPUTER PHYSICAL SECURITY DEVICE

(75) Inventors: Stewart R. Carl, Palo Alto, CA (US); Alice Kasahara, Hayward, CA (US); Arthur H. Zarnowitz, San Jose, CA (US); William R. Murray, Jr., Redwood City, CA (US)

(73) Assignee: ACCO USA, Inc., Lincolnshire, CA (US)

Reexamination Request:
No. 90/007,225, Sep. 24, 2004

Reexamination Certificate for:

| | |
|---|---|
| Patent No.: | **6,006,557** |
| Issued: | **Dec. 28, 1999** |
| Appl. No.: | **08/927,334** |
| Filed: | **Sep. 11, 1997** |

( * ) Notice: This patent is subject to a terminal disclaimer.

Related U.S. Application Data

(63) Continuation of application No. 08/385,715, filed on Feb. 8, 1995, now abandoned, which is a continuation-in-part of application No. 08/307,113, filed on Sep. 16, 1994, now Pat. No. 5,502,989, which is a division of application No. 08/138,634, filed on Oct. 15, 1993, now Pat. No. 6,000,251, which is a continuation-in-part of application No. 08/042,851, filed on Apr. 5, 1993, now Pat. No. 5,381,685, which is a continuation of application No. 07/824,964, filed on Jan. 24, 1992, now abandoned, and a continuation-in-part of application No. 08/006,311, filed on Jan. 19, 1993, now abandoned.

(51) Int. Cl.
*E05B 69/00* (2006.01)

(52) U.S. Cl. ..... 70/58; 70/14; 70/57

(58) Field of Classification Search ..... 70/14, 70/18, 30, 49, 57, 58, 232, 423–430; 248/505, 248/551, 553; 411/85, 216, 217, 343, 349, 411/549, 552, 553, 555, 910
See application file for complete search history.

(56) References Cited

U.S. PATENT DOCUMENTS

| | | | |
|---|---|---|---|
| 87,045 | A | 2/1869 | Holmes |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 786,842 | A | 4/1905 | Robeson |
| 881,384 | A | 3/1908 | Wheeler |
| 934,928 | A | 9/1909 | Michel |
| 942,537 | A | 12/1909 | Batdorf |
| 952,411 | A | 3/1910 | Billy |

(Continued)

FOREIGN PATENT DOCUMENTS

| | | |
|---|---|---|
| CA | 454901 | 3/1949 |
| CA | 987121 | 4/1976 |
| CA | 791384 | 8/1988 |

(Continued)

OTHER PUBLICATIONS

Translation of DE 3824393 (pub. date Jul. 27, 1989) by U.SPTO, translation date—Oct. 25, 2005.*

(Continued)

*Primary Examiner*—Jimmy G. Foster

(57) ABSTRACT

An apparatus which inhibits the theft of equipment such as personal computers is disclosed. The equipment typically includes an external wall provided with a specially designed, approximately rectangular slot having preselected dimensions. An attachment mechanism includes a housing for a spindle having a first portion rotatable within the housing, a shaft extending outwardly from the housing, and a crossmember at the end of the shaft having peripheral dimensions closely conforming to the internal dimensions of the slot. The spindle is then rotated 90° to misalign the crossmember with the slot, thereby attaching the attachment mechanism rigidly to the external wall. A cable is secured to the housing and to an immovable object so that the equipment cannot be stolen.

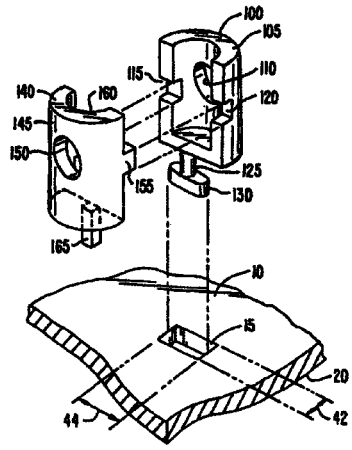

U.S. PATENT DOCUMENTS

| | | | |
|---|---|---|---|
| 1,004,333 | A | 9/1911 | Alsterberg |
| 1,050,276 | A | 1/1913 | Johnson |
| 1,101,450 | A | 6/1914 | Kerry |
| 1,432,546 | A | 10/1922 | Gillom |
| 1,452,471 | A | 4/1923 | Kline |
| 1,470,937 | A | 10/1923 | Schou |
| 1,534,936 | A | 4/1925 | Fishchbach |
| 1,672,333 | A | 6/1928 | Miller |
| 1,786,511 | A | 12/1930 | Warren |
| 1,978,935 | A | 10/1934 | Douglas |
| 2,001,354 | A | 5/1935 | Smith |
| 2,102,583 | A | 12/1937 | Alberg |
| 2,109,109 | A | 2/1938 | Finch |
| 2,130,216 | A | 9/1938 | Zaninovich |
| 2,172,208 | A | 9/1939 | Kurtzon |
| 2,190,661 | A | 2/1940 | Hauer |
| 2,383,397 | A | 8/1945 | Lofqwist |
| 2,405,400 | A | 8/1946 | Butterfiled |
| 2,435,876 | A | 2/1948 | De Swart |
| 2,469,874 | A | 5/1949 | Fetsko, Jr. |
| 2,480,662 | A | 8/1949 | McKinzie |
| 2,530,560 | A | 11/1950 | Young |
| 2,577,958 | A | 12/1951 | Elsberg |
| 2,594,012 | A | 4/1952 | Griffin |
| 2,660,084 | A | 11/1953 | Newman |
| 2,677,261 | A | 5/1954 | Jacobi |
| 2,729,418 | A | 1/1956 | Maynard |
| 2,800,090 | A | 7/1957 | Reid |
| 2,963,310 | A | 12/1960 | Abolins |
| 3,091,011 | A | 5/1963 | Campbell |
| 3,101,695 | A | 8/1963 | Honeyman, Jr. |
| 3,130,571 | A | 4/1964 | Neumann |
| 3,136,017 | A | 6/1964 | Preziosi |
| 3,171,182 | A | 3/1965 | Danahy |
| 3,174,384 | A | 3/1965 | Vanni |
| 3,200,694 | A | 8/1965 | Rapata |
| 3,211,408 | A | 10/1965 | Schaefer |
| 3,213,745 | A | 10/1965 | Dwyer |
| 3,220,077 | A | 11/1965 | Newcomber, Jr. et al. |
| 3,276,835 | A | 10/1966 | Hall |
| 3,469,874 | A | 9/1969 | Mercurio |
| 3,486,158 | A | 12/1969 | Soltysik et al. |
| 3,521,845 | A | 7/1970 | Sweda et al. |
| 3,590,608 | A | 7/1971 | Smyth et al. |
| 3,625,031 | A | 12/1971 | Alley, III |
| 3,634,963 | A | 1/1972 | Hermann |
| 3,684,163 | A | 8/1972 | Foote |
| 3,722,239 | A | 3/1973 | Mestre |
| 3,727,934 | A | 4/1973 | Averbook et al. |
| 3,737,135 | A | 6/1973 | Bertolini |
| 3,754,420 | A | 8/1973 | Oellerich |
| 3,765,197 | A | 10/1973 | Foote |
| 3,771,336 | A | 11/1973 | Raskin |
| 3,772,645 | A | 11/1973 | Odenz et al. |
| 3,782,146 | A | 1/1974 | Franke |
| 3,785,183 | A | 1/1974 | Sander |
| 3,798,934 | A | 3/1974 | Wright et al. |
| 3,826,510 | A | 7/1974 | Halter |
| D232,416 | S | 8/1974 | Gazda et al. |
| 3,836,704 | A | 9/1974 | Coules |
| 3,859,826 | A | 1/1975 | Singer et al. |
| 3,866,873 | A | 2/1975 | Bohii |
| 3,875,645 | A | 4/1975 | Tucker et al. |
| 3,905,570 | A | 9/1975 | Nieuwveld |
| 3,910,079 | A | 10/1975 | Gassaway |
| 3,910,081 | A | 10/1975 | Pender |
| 3,939,752 | A | 2/1976 | Koscik |
| 3,986,780 | A | 10/1976 | Nivet |
| 3,990,276 | A | 11/1976 | Shontz |
| 3,999,410 | A | 12/1976 | Hall |
| 4,003,228 | A | 1/1977 | Lievens et al. |
| 4,004,440 | A | 1/1977 | Dreyer |
| 4,007,613 | A | 2/1977 | Gassaway |
| 4,018,339 | A | 4/1977 | Pritz |
| 4,028,913 | A | 6/1977 | Falk |
| 4,028,916 | A | 6/1977 | Pender |
| 4,047,748 | A | 9/1977 | Whaley et al. |
| 4,055,973 | A | 11/1977 | Best |
| 4,057,984 | A | 11/1977 | Avaiusini |
| 4,065,083 | A | 12/1977 | Gassaway |
| 4,066,195 | A | 1/1978 | Dickler |
| 4,066,231 | A | 1/1978 | Bahner |
| 4,104,951 | A | 8/1978 | Leitner |
| 4,114,409 | A | 9/1978 | Scire |
| 4,118,902 | A | 10/1978 | Saxton |
| 4,123,922 | A | 11/1978 | Kuenstler |
| 4,131,001 | A | 12/1978 | Gotto |
| 4,212,175 | A | 7/1980 | Zakow |
| 4,223,542 | A | 9/1980 | Basseches |
| 4,252,007 | A | 2/1981 | Kerley |
| 4,263,833 | A | 4/1981 | Loudin |
| 4,300,371 | A | 11/1981 | Herwick et al. |
| 4,311,883 | A | 1/1982 | Kidney |
| 4,337,462 | A | 6/1982 | Lemelson |
| 4,391,110 | A | 7/1983 | Nielsen |
| 4,394,101 | A | 7/1983 | Richer |
| 4,418,550 | A | 12/1983 | Hamilton |
| 4,419,034 | A | 12/1983 | DiMartino |
| 4,442,571 | A | 4/1984 | Davis et al. |
| 4,448,049 | A | 5/1984 | Murray |
| 4,462,233 | A | 7/1984 | Horetzke |
| 4,466,259 | A | 8/1984 | Osgood |
| 4,471,980 | A | 9/1984 | Hickman |
| 4,478,545 | A | 10/1984 | Mizusawa |
| 4,501,460 | A | 2/1985 | Sisler |
| 4,502,305 | A | 3/1985 | Bakker |
| 4,527,405 | A | 7/1985 | Renick et al. |
| 4,570,465 | A | 2/1986 | Bennett |
| 4,579,492 | A | 4/1986 | Kazino |
| 4,584,856 | A | 4/1986 | Petersdorff et al. |
| 4,586,843 | A | 5/1986 | Heng et al. |
| 4,593,273 | A | 6/1986 | Narcisse |
| 4,598,272 | A | 7/1986 | Cox |
| 4,603,829 | A | 8/1986 | Koike et al. |
| 4,610,587 | A | 9/1986 | Wollar |
| 4,616,490 | A | 10/1986 | Robbins |
| 4,640,106 | A | 2/1987 | Derman |
| 4,651,544 | A | 3/1987 | Hungerford |
| 4,655,057 | A | 4/1987 | Derman |
| 4,656,848 | A | 4/1987 | Rose |
| 4,667,491 | A | 5/1987 | Lokken et al. |
| 4,676,080 | A | 6/1987 | Schwarz |
| 4,680,949 | A | 7/1987 | Stewart |
| 4,685,312 | A | 8/1987 | Lakoski et al. |
| 4,691,891 | A | 9/1987 | Dionne |
| 4,692,968 | A | 9/1987 | Girard |
| 4,704,881 | A | 11/1987 | Sloop, Sr. |
| 4,733,840 | A | 3/1988 | D'Amore |
| 4,738,428 | A | 4/1988 | Themistos |
| 4,741,185 | A | 5/1988 | Weinert et al. |
| 4,768,361 | A | 9/1988 | Derman |
| 4,770,583 | A | 9/1988 | Lindberg |
| 4,779,434 | A | 10/1988 | Derman |
| 4,785,291 | A | 11/1988 | Hawthorne |
| 4,801,232 | A | 1/1989 | Hempel |
| 4,804,943 | A | 2/1989 | Soleimani |
| 4,805,426 | A | 2/1989 | Dimmick et al. |
| 4,813,252 | A | 3/1989 | Ray |
| 4,826,193 | A | 5/1989 | Davis |
| 4,834,600 | A | 5/1989 | Lemke |
| 4,842,912 | A | 6/1989 | Hutter, III |

| | | | |
|---|---|---|---|
| 4,843,848 | A | 7/1989 | Igelmund |
| 4,856,304 | A | 8/1989 | Derman |
| 4,856,305 | A | 8/1989 | Adams |
| 4,858,455 | A | 8/1989 | Kuo |
| 4,862,716 | A | 9/1989 | Derman |
| 4,869,082 | A | 9/1989 | Appelbaum |
| 4,870,840 | A | 10/1989 | Klein |
| 4,893,488 | A | 1/1990 | Klein |
| 4,907,111 | A | 3/1990 | Derman |
| 4,907,716 | A | 3/1990 | Wankel et al. |
| 4,918,952 | A | 4/1990 | Lakoski |
| 4,924,683 | A | 5/1990 | Derman |
| 4,924,693 | A | 5/1990 | College |
| 4,938,040 | A | 7/1990 | Humphreys, Jr. |
| 4,959,635 | A | 9/1990 | Wilson |
| 4,959,979 | A | 10/1990 | Filipow et al. |
| 4,964,285 | A | 10/1990 | Lakoski |
| 4,966,511 | A | 10/1990 | Lee |
| 4,969,342 | A | 11/1990 | Marchiori |
| 4,978,265 | A | 12/1990 | De Wan |
| 4,979,382 | A | 12/1990 | Perry |
| 4,985,695 | A | 1/1991 | Wilkinson et al. |
| 4,986,097 | A | 1/1991 | Derman |
| 4,993,244 | A | 2/1991 | Osman |
| 5,001,460 | A | 3/1991 | Basson |
| 5,001,854 | A | 3/1991 | Derman |
| 5,010,748 | A | 4/1991 | Derman |
| 5,022,242 | A | 6/1991 | Povilaitis |
| 5,024,072 | A | 6/1991 | Lee |
| 5,027,627 | A | 7/1991 | Derman |
| 5,050,836 | A | 9/1991 | Makous |
| 5,052,199 | A | 10/1991 | Derman |
| 5,063,763 | A | 11/1991 | Johnson |
| 5,067,151 | A | 11/1991 | Inagaki |
| 5,076,079 | A | 12/1991 | Monoson |
| 5,082,232 | A | 1/1992 | Wilson |
| 5,082,233 | A | 1/1992 | Ayers et al. |
| 5,099,663 | A | 3/1992 | Dearstine |
| 5,117,661 | A | 6/1992 | Carl et al. |
| 5,119,649 | A | 6/1992 | Spence |
| 5,135,197 | A | 8/1992 | Kelley et al. |
| 5,138,785 | A | 8/1992 | Paterson |
| 5,146,769 | A | 9/1992 | Smith |
| 5,154,456 | A | 10/1992 | Moore |
| 5,184,798 | A | 2/1993 | Wilson |
| 5,197,706 | A | 3/1993 | Braithwaite et al. |
| 5,223,815 | A | 6/1993 | Rosenthal et al. |
| D337,040 | S | 7/1993 | Carl |
| 5,228,319 | A | 7/1993 | Holley et al. |
| 5,279,136 | A | 1/1994 | Perry |
| 5,317,304 | A | 5/1994 | Choi |
| 5,327,752 | A | 7/1994 | Myers et al. |
| D350,473 | S | 9/1994 | Simon |
| 5,349,834 | A | 9/1994 | Davidge |
| 5,351,507 | A | 10/1994 | Derman |
| 5,351,508 | A | 10/1994 | Kelley |
| 5,361,610 | A | 11/1994 | Sanders |
| 5,370,488 | A | 12/1994 | Sykes |
| 5,377,512 | A | 1/1995 | Kelley |
| 5,381,685 | A | 1/1995 | Carl et al. |
| 5,390,514 | A | 2/1995 | Harmon |
| 5,390,977 | A | 2/1995 | Miller |
| 5,394,713 | A | 3/1995 | Harmon |
| 5,397,171 | A | 3/1995 | Leach |
| 5,398,530 | A | 3/1995 | Derman |
| 5,400,622 | A | 3/1995 | Harmon |
| 5,406,809 | A | 4/1995 | Igelmund |
| 5,412,959 | A | 5/1995 | Bentley |
| 5,421,667 | A | 6/1995 | Leyden et al. |
| 5,466,022 | A | 11/1995 | Derman |
| 5,473,917 | A | 12/1995 | Say |
| 5,489,173 | A | 2/1996 | Hofle |
| 5,493,878 | A | 2/1996 | Murray et al. |
| 5,502,989 | A | 4/1996 | Murray et al. |
| 5,520,031 | A | 5/1996 | Davidge |
| D370,473 | S | 6/1996 | Derman |
| 5,548,981 | A | 8/1996 | Kirk |
| 5,579,657 | A | 12/1996 | Makous |
| 5,593,878 | A | 1/1997 | Knopf et al. |
| 5,603,416 | A | 2/1997 | Richardson et al. |
| 5,608,605 | A | 3/1997 | Siow et al. |
| 5,611,223 | A | 3/1997 | Spitzer |
| 5,622,064 | A | 4/1997 | Gluskoter et al. |
| 5,687,592 | A | 11/1997 | Penniman et al. |
| 5,692,400 | A | 12/1997 | Bliven et al. |
| 5,709,110 | A | 1/1998 | Greenfield et al. |
| 5,722,268 | A | 3/1998 | Choi |
| 5,502,989 | A | 4/1998 | Murray et al. |
| 5,787,739 | A | 8/1998 | Derman |
| 5,791,171 | A | 8/1998 | Kelley |
| 5,794,463 | A | 8/1998 | McDaid |
| 5,836,183 | A | 11/1998 | Derman |
| 5,870,281 | A | 2/1999 | Kim |
| 5,875,657 | A | 3/1999 | Kelley |
| 5,913,907 | A | 6/1999 | Lee |
| 5,963,131 | A | 10/1999 | D'Angelo et al. |
| 6,000,251 | A | 12/1999 | Murray et al. |
| 6,000,252 | A | 12/1999 | Murray et al. |
| 6,006,557 | A | 12/1999 | Carl et al. |
| 6,038,891 | A | 3/2000 | Zeren et al. |
| 6,081,974 | A | 7/2000 | McDaid |
| 6,112,562 | A | 9/2000 | Murray, Jr. et al. |
| 6,133,830 | A | 10/2000 | D'Angelo et al. |
| 6,155,088 | A | 12/2000 | Murray, Jr. et al. |
| 6,173,591 | B1 | 1/2001 | Derman |
| 6,199,413 | B1 | 3/2001 | McDaid et al. |
| 6,227,017 | B1 | 5/2001 | Igelmund |
| 6,265,974 | B1 | 7/2001 | D'Angelo et al. |
| 6,301,940 | B1 | 10/2001 | Derman et al. |
| 6,317,936 | B1 | 11/2001 | McDaid et al. |
| 6,360,405 | B1 | 3/2002 | McDaid et al. |
| 6,513,350 | B1 | 2/2003 | Hurd et al. |
| 6,553,794 | B1 | 4/2003 | Murray, Jr. et al. |
| 6,588,241 | B1 | 7/2003 | Murray, Jr. et al. |
| 6,591,642 | B1 | 7/2003 | Kuo |
| 6,735,990 | B1 | 5/2004 | Murray, Jr. et al. |
| 6,758,069 | B2 | 7/2004 | Derman |
| 2003/0101778 | A1 | 6/2003 | Carl et al. |
| 2004/0040350 | A1 | 3/2004 | Derman |

FOREIGN PATENT DOCUMENTS

| | | |
|---|---|---|
| DE | 329934 | 12/1920 |
| DE | 335741 | 4/1921 |
| DE | 361068 | 4/1923 |
| DE | 456219 | 2/1928 |
| DE | 577757 | 8/1932 |
| DE | 3202700 | 8/1983 |
| DE | 3407723 A1 | 9/1985 |
| DE | 3824393 | 7/1989 |
| FR | 455740 | 8/1913 |
| FR | 877220 | 12/1942 |
| FR | 1026519 | 4/1953 |
| FR | 1065107 | 1/1955 |
| FR | 2308006 | 11/1976 |
| FR | 2636686 A1 | 3/1990 |
| GB | 447091 | 5/1936 |
| GB | 1256295 | 12/1971 |
| GB | 1376011 | 12/1974 |
| GB | 2109109 A | 5/1983 |
| GB | 2234856 A | 2/1991 |
| IT | 451949 | 10/1949 |
| JP | 37-7592 | 9/1960 |

| | | |
|---|---|---|
| JP | 49-91096 | 8/1974 |
| JP | 52-36813 | 3/1977 |
| JP | 57-25092 | 2/1982 |
| JP | 57-179618 | 11/1982 |
| NO | 14095 | 5/1905 |
| WO | WO 95/10860 | 4/1985 |
| WO | WO 86/00396 | 1/1986 |
| WO | WO 93/15295 | 8/1993 |
| WO | WO 96/07002 | 3/1996 |

OTHER PUBLICATIONS

Kensington MicroSaver Computer Lock Box and Literature, 3 pages.
Kensington Product News Release; "Kensington Wins Case Protecting Cable Lock Status", 2003, 1 page.
*ACCO Brands, Inc.* v. *Micro Security Devices, Inc.* Federal Circuit Court Order Granting Defendant's Motion for Summary Judgment, Jul. 23, 2002, 13 pages.
U.S. Appl. No. 90/007,674, Myers.
U.S. Appl. No. 95/000,116, Murray, Jr.
Kensington Pass Proof User Manual, 1990, pp. 4–17, 4–19.
Los Angeles Times, Jan. 12, 1989. Part V, p. 10.
Kablit Security Products Catalog. p. 9, (No Date).
Flaxguard Security System, Philadelphia Security Products, 1 page (no date on page).
U.S. Appl. No. 09/441,142, Murray et al.
U.S. Appl. No. 09/603,240, Murray et al.
U.S. Appl. No. 09/603,394, Murray et al.
U.S. Appl. No. 09/804,973, Murray et al.
U.S. Appl. No. 10/455,072, Kuo.
U.S. Appl. No. 10/839,521, Murray et al.
U.S. Appl. No. 90/007,221, Murray et al.
U.S. Appl. No. 10/970,060, Merrem et al.
U.S. Appl. No. 11/000,397, Merrem et al.
U.S. Appl. No. 11/009,813, Murray et al.
U.S. Appl. No. 11/009,335, Murray et al.
U.S. Appl. No. 11/035,946, Kuo.
Kablit Security System Catalog, pp. 7, 93, 1966. Computer and Office Equipment Security Catalog. 1990, Secure–it, Inc. 18 Maple Court, East Longmeadow, MA 01028.
Kensington Product Brochure for Kensington Apple Laser Writer and Macintosh Portable Security Systems, Computer and Office Equipment Security Catalog, 1990, Secure–It, Inc., 18 Maple Court, East Longmeadow, MA 01028.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, Lines 3-5.

This a Continuation of application Ser. No. 08/385,715, filed Feb. 8, 1995 now abandoned, the disclosure of which is incorporated by reference*, which is a Continuation-In-Part of application Ser. No. 08/307,113, filed on Sep. 16, 1994, now U.S. Pat. No. 5,502,989, which is a Divisonal of application Ser. No. 08/138,634, filed on Oct. 15, 1993, now U.S. Pat. No. 6,000,251, which is a Continuation-In-Part of application Ser. No. 08/042,851 filed on Apr. 5, 1993, now U.S. Pat. No. 5,381,685, which is a Continuation of application Ser. No. 07/824,964, filed on Jan. 24, 1992, now abandoned, and a Continuation-In-Part of application Ser. No. 08/006,311, filed on Jan. 19, 1993, now abandoned.*

AS A RESULT OF REEXAMINATION, IT HAS BEEN DETERMINED THAT:

The patentability of claims 2, 6, 7 and 9-12 is confirmed.

Claims 1, 3-5 and 8 are cancelled.

New claims 13-15 are added and determined to be patentable.

*13. The security lock of claim 9 wherein the locking spindle has two locking spindle engagement members formed by curved portions of the body portion of the locking spindle, wherein the body portion of the locking spindle includes a first aperture, wherein said anchor spindle body portion has a second aperture and two anchor spindle engagement members formed by vertical sides of the anchor spindle body portion, wherein the two anchor spindle engagement members and the two locking spindle engagement members are adapted for slideably engaging said anchor spindle body portion to said body portion of the locking spindle.*

*14. The security lock of claim 9 wherein the locking spindle has two locking spindle engagement members formed by curved portions of the body portion of the locking spindle, wherein the body portion of the locking spindle includes a first flat portion including a first aperture, wherein said anchor spindle body portion has a second flat portion including a second aperture and two anchor spindle engagement members formed by vertical sides of the anchor spindle body portion, wherein the two anchor spindle engagement members and the two locking spindle engagement members are adapted for interlocking and slideably engaging said anchor spindle body portion to said body portion of the locking spindle, wherein the first and second apertures are aligned when the head portion is in the second position.*

*15. The security lock of claim 9 wherein the locking spindle has two locking spindle engagement members, wherein the body portion of the locking spindle is curved and includes a first aperture, wherein said anchor spindle body portion is curved and has a second aperture and two anchor spindle engagement members, wherein the two anchor spindle engagement members and the two locking spindle engagement members are adapted for engaging said anchor spindle body portion to said body portion of the locking spindle, and wherein the body portion of the locking spindle and the anchor spindle body portion form a cylinder.*

* * * * *